US006620764B1

(12) United States Patent
Maruyama

(10) Patent No.: US 6,620,764 B1
(45) Date of Patent: Sep. 16, 2003

(54) IMAGE RECEPTOR SURFACE AND METHOD OF MAKING THE SAME

(75) Inventor: Satoshi Maruyama, Osaka (JP)

(73) Assignee: Sakura Color Products Corporation, Osaka (JP)

( * ) Notice: Subject to any disclaimer, the term of this patent is extended or adjusted under 35 U.S.C. 154(b) by 0 days.

(21) Appl. No.: 09/497,016

(22) Filed: Feb. 2, 2000

Related U.S. Application Data

(62) Division of application No. 09/036,299, filed on Mar. 6, 1998, now Pat. No. 6,313,067.

(30) Foreign Application Priority Data

Mar. 10, 1997 (JP) ..... 9-74612

(51) Int. Cl.[7] ..... B41M 5/035; B41M 5/38

(52) U.S. Cl. ..... 503/227; 428/34.7; 428/35.7; 503/201

(58) Field of Search ..... 8/471; 428/195, 428/913, 914, 34.6, 34.7, 35.7; 503/227

(56) References Cited

U.S. PATENT DOCUMENTS

| | | | | |
|---|---|---|---|---|
| 4,797,016 A | | 1/1989 | Iahr | 400/237 |
| 5,318,370 A | | 6/1994 | Nehowig | 400/613 |
| 5,468,711 A | * | 11/1995 | Suzuki et al. | 503/201 |
| 5,686,382 A | * | 11/1997 | Suzuki et al. | 503/201 |

FOREIGN PATENT DOCUMENTS

| | | |
|---|---|---|
| DE | 4218924 | 6/1992 |
| EP | 0722840 | 7/1996 |
| EP | 0785083 | 7/1997 |
| EP | 0807912 | 11/1997 |
| WO | WO9524316 | 9/1995 |

* cited by examiner

*Primary Examiner*—B. Hamilton Hess
(74) *Attorney, Agent, or Firm*—Wood, Phillips, Katz, Clark & Mortimer

(57) ABSTRACT

An image receptor surface which receives an image of a sublimation dye thermally transferred thereto from a foundation sheet for formation of the image therein, the image receptor surface comprising a thermochromatic layer.

The thermochromatic layer is a layer of a thermochromatic ink, and contains at least either one of an epoxy resin and an epoxy acrylate resin. The thermochromatic layer reversibly changes its color between an image concealable color and transparence in a predetermined temperature range.

The image receptor surface may be formed of any of various materials or articles such as metals, wood materials, glass materials, ceramics, plastics, fabrics and fibrous materials for any applications, especially a mug.

11 Claims, 4 Drawing Sheets

IMAGE RECEPTOR SURFACE AND METHOD OF MAKING THE SAME

CROSS REFERENCE

This application is a division of Ser. No. 09/036,299, entitled "Image Receptor Surface and Method of Making the Same" filed Mar. 6, 1998, now U.S. Pat. No. 6,313,067.

FIELD OF THE INVENTION

The present invention relates to an image receptor surface to be used for image formation through thermal transfer. More particularly, the invention relates to an image receptor surface which offers an interesting aesthetic effect by making an image transferred thereto visible or invisible depending on the temperature thereof, and to a method for making the same.

BACKGROUND OF THE INVENTION

Various thermal image transfer methods have been conventionally known. One of the thermal image transfer methods heretofore proposed is such that a polyester film carrying an image printed thereon with a sublimation dye recording agent is used as a thermal transfer sheet and the image on the thermal transfer sheet is thermally transferred onto an image receptor surface by heat and pressure. The term "image receptor surface" is herein meant by a surface or layer of an image receptor to which an image of a sublimation dye recording agent is thermally transferred for formation of the image therein. The image receptor surface is provided on a base to ensure effective thermal image transfer. Therefore, the image receptor surface should have a good dye affinity and dye fixability.

The prior art image receptor surface only serves to fix the dye transferred thereto, but does not offer any aesthetic effects to an article on which the image is formed. In this connection, there has been a demand for a thermal image transfer method which offers aesthetic effects by employing an image receptor surface. Such a demand can be satisfied, for example, by providing an image receptor surface which is adapted to conceal an image (including an illustration and letters) thermally transferred thereto at a temperature out of a predetermined temperature range and turn colorless to make the concealed image visible at a temperature within the predetermined temperature range. More specifically, such an image receptor surface is formed on a surface of a base such as a mug, and an image including unique pictorial and textual messages desired to be sent to a specific person is thermally transferred to the image receptor surface. At this time, the image formed in the image receptor surface is latent but, when the person pours hot water into the mug, the latent image is made visible so that the person receives the unique pictorial and textual messages.

SUMMARY OF THE INVENTION

As a result of intensive studies, the inventors of the present invention have found that the aforesaid idea can be realized by employing the following image receptor surface, and attained the present invention. In accordance with the present invention, the image receptor surface receives an image of a sublimation dye thermally transferred thereon from a foundation sheet for formation of the image therein, and comprises a thermochromatic layer.

In accordance with one preferred embodiment of the present invention, the image receptor surface, which is formed on an article, is thermochromatic so that its color changes, for example, when the image receptor surface is heated up to a predetermined temperature range. An image (including an illustration and letters) is thermally transferred to the image receptor surface in a conventional manner. The image thus transferred to the image receptor surface is concealed in an image formation area on the article by the color of the image receptor surface, for example, at ordinary temperature and, when the article is heated, the color of the image receptor surface is changed so that an interesting aesthetic effect is added to the image formation area.

In the invention, a thermochromatic ink may be used for formation of the thermochromatic layer of the image receptor surface. The thermochromatic ink is herein meant by an ink composition which changes its color depending on the temperature thereof. In accordance with one preferred embodiment of the present invention, there is provided an image receptor surface which comprises a thermochromatic layer formed of a thermochromatic ink.

It is an object of the present invention to provide a unique image receptor surface comprising a thermochromatic layer which has an image concealable color at a temperature out of a predetermined temperature range so that an image thermally transferred thereto is invisible or latent, and becomes colorless or transparent at a temperature within the predetermined temperature range so that the latent image is made visible, and to provide a method of making the same.

PREFERRED EMBODIMENTS OF THE INVENTION

Figure 1:
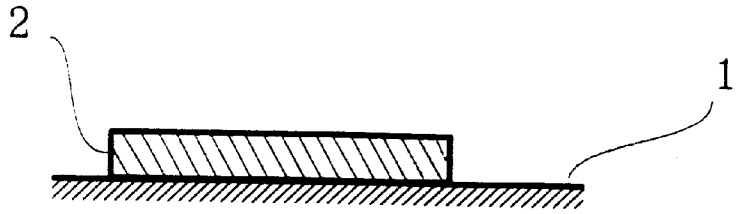
FIG. 1 is an enlarged schematic sectional view illustrating an image receptor surface formed on a mug (base) in accordance with one embodiment of the present invention.

In the present invention, any of various conventional methods can be employed to form the thermochromatic layer of the image receptor surface by using the thermochromatic ink. For example, the thermochromatic ink is applied on the surface of the article by a printing method or by a thermal transfer method which employs a transfer paper or a transfer sheet having a thermochromatic ink layer formed on a foundation sheet. Usable as the transfer paper and the transfer sheet in the thermal transfer method are those disclosed in Japanese Unexamined Patent Publications No. 7-32797 (1995) and No. 7-186597 (1995). In accordance with another preferred embodiment of the present invention, there is provided an image receptor surface which, comprises a thermochromatic layer formed of a thermochromatic ink through thermal transfer.

In the present invention, any of various known thermochromatic inks may be used for formation of the thermochromatic layer of the image receptor surface. Examples of the known thermochromatic inks include: ink compositions which contain a thermochromatic pigment dispersed in a synthetic thermosetting resin; UV-curing thermochromatic ink compositions, such as disclosed in Japanese Unexamined Patent Publication No. 7-324178 (1995), which contain thermochromatic microcapsules and a photopolymerizable resin composition as essential components; UV-curing thermochromatic ink compositions, such as disclosed in Japanese Unexamined Patent Publication No. 8-48923 (1996), which contain a thermochromatic pigment dispersed in a synthetic UV-curing resin; and ink compositions which contain a thermochromatic pigment dispersed in a thermosetting resin.

In accordance with further another preferred embodiment of the present invention, there is provided an image receptor surface which comprises a thermochromatic layer capable of receiving a sublimation dye thermally transferred thereto. If the thermochromatic layer serves as a receptor layer capable of receiving the sublimation dye, the formation of the image receptor surface is efficiently facilitated because the thermochromatic layer has the sublimation dye receiving function as well as the thermochromatic function.

The thermochromatic layer of the image receptor surface (or the thermochromatic ink used for the formation of the thermochromatic layer) may contain a synthetic resin for fixation of the thermochromatic pigment and/or the thermally transferred sublimation dye. The synthetic resin to be used is not particularly limited, but may be any of those advantageously used in conventional practices for fixation of the transferred sublimation dye. In accordance with still another preferred embodiment of the present invention, there is provided an image receptor surface which comprises a thermochromatic layer containing at least one resin selected from the group consisting of thermosetting resins, UV-curing resins and thermoplastic resins. Particularly, for fixation of a clear image without any blur, it is a critical requirement in the selection of the synthetic resin that the transferred sublimation dye can be stably fixed in the image receptor surface.

More specifically, thermosetting resins are preferably used as the synthetic resin, among which an epoxy resin and/or an epoxy acrylate resin are particularly preferred. A thermosetting resin may be used in combination with a thermoplastic resin such as an acryl resin or a polyester. In accordance with yet other preferred embodiments of the present invention, there are provided: an image receptor surface which comprises a thermochromatic layer containing an epoxy resin and/or an epoxy acrylate resin; and an image receptor surface which comprises a thermochromatic layer containing an epoxy resin and/or an epoxy acrylate resin and an acryl resin and/or a polyester.

The color of the image receptor surface is not particularly limited. The image receptor surface may be adapted not only to change its color but also to turn transparent when heated. In such a case, the image receptor surface is preferably adapted to reversibly change its color by application of heat. In accordance with still another preferred embodiment of the present invention, there is provided an image receptor surface which comprises a thermochromatic layer which reversibly changes its color between an image concealable color and transparence in a predetermined temperature range. More specifically, the image receptor surface to be formed on the article is a thermochromatic image receptor surface which is adapted to conceal the thermally transferred image, for example, at ordinary temperature and to lose its image concealable power when the image receptor surface is heated up to the predetermined temperature range. After such a thermochromatic image receptor surface is formed on an article, an image (including an illustration and letters) is thermally transferred to the image receptor surface. At ordinary temperature, the image transferred to the image receptor surface is a latent image concealed by the color of the image receptor surface. When the article is heated, the color of the image receptor surface fades away so that the latent image is made visible in the image receptor surface.

In accordance with still other preferred embodiments of the present invention, there are provided an image receptor surface which comprises a thermochromatic layer which reversibly changes its color between an image concealable color and an image nonconcealable color in a predetermined temperature range.

In the present invention, the image receptor surface may comprise a resin layer as well as the thermochromatic layer. The resin layer preferably functions as a receptor layer. If the resin layer serves as the receptor layer capable of receiving the sublimation dye thermally transferred thereto, the sublimation dye can be received by the resin layer as well as the thermochromatic layer. The provision of the resin layer permits the image receptor surface to offer various aesthetic effects. Where the thermochromatic layer is formed on the resin layer to partially cover the resin layer or to cover a part of the resin layer in the image receptor surface, the image can be formed in an area other than the thermochromatic layer. That is, a portion of the image thermally transferred to the image receptor surface is concealed by the thermochromatic layer, while the other portion of the image is not concealed. Therefore, when the thermochromatic layer turns transparent or into a pale color, the latent portion of the image is made visible so as to offer an interesting aesthetic effect cooperatively with the originally visible portion of the image in the image receptor surface. Where the thermochromatic layer is formed on the resin layer, the image concealing power of the thermochromatic layer can be enhanced.

In accordance with still other preferred embodiments of the present invention, there are provided: an image receptor surface which comprises a resin layer and a thermochromatic layer; an image receptor surface which comprises a resin layer and a thermochromatic layer formed on the resin layer; and an image receptor surface which comprises a resin layer as a receptor layer and a thermochromatic layer formed on the resin layer to partially cover the resin layer. The thermochromatic layer may be formed on the resin layer to entirely cover the resin layer.

Where the resin layer is formed directly on a base, e.g., an article, the resin layer is preferably adhesive to the base. In accordance with yet another preferred embodiment of the present invention, there is provided an image receptor surface which comprises a thermochromatic layer and a resin layer, wherein the thermochromatic layer is formed on the resin layer, and wherein the resin layer is formed directly on a base and is adhesive to the base.

A resin to be used as a material for the resin layer of the image receptor surface is not particularly limited, but any of various synthetic resins may be used. For example, the resin may be at least one resin selected from the group consisting of thermosetting resins, UV-curing resins and thermoplastic resins. It is particularly preferred that the resin layer contains an epoxy resin and/or an epoxy acrylate resin and an acryl resin and/or a polyester. In accordance with still other preferred embodiments of the present invention, there are provided: an image receptor surface which comprises a thermochromatic layer and a resin layer, wherein the resin layer contains an epoxy resin and/or an epoxy acrylate resin and an acryl resin and/or a polyester; and an image receptor surface which comprises a thermochromatic layer and a resin layer, wherein the thermochromatic layer is formed on the resin layer and contains an epoxy resin and/or an epoxy acrylate resin, and wherein the resin layer contains an epoxy resin and/or an epoxy acrylate resin and an acryl resin and/or a polyester.

The color change of the image receptor surface itself offers an interesting aesthetic effect. In addition, the image formed in the image receptor surface through thermal transfer as described above offers a further interesting aesthetic effect cooperatively with the color change. In accordance with yet other preferred embodiments of the present invention, there are provided: an image receptor surface which comprises a thermochromatic layer in which an image is formed through thermal transfer; and an image receptor surface which comprises a thermochromatic layer adapted to reversibly change its color between a image concealable color and transparence, wherein an image is formed in the thermochromatic layer through thermal transfer.

In accordance with still other preferred embodiments of the present invention, there are provided: an image receptor surface which comprises a thermochromatic layer and a resin layer, wherein the thermochromatic layer is formed on the resin layer and contains an epoxy resin and/or an epoxy acrylate resin, wherein the resin layer contains an epoxy resin and/or an epoxy acrylate resin and an acryl resin and/or a polyester, wherein the thermochromatic layer is adapted to reversibly change its color between an image concealable color and transparence in a predetermined temperature range, and wherein an image is formed in the thermochromatic layer and/or the resin layer through thermal transfer; and an image receptor surface which comprises a thermochromatic layer and a resin layer, wherein the thermochromatic layer is formed on the resin layer to partially cover the resin layer and contains an epoxy resin and/or an epoxy acrylate resin, wherein the resin layer contains an epoxy resin and/or an epoxy acrylate resin and an acryl resin and/or a polyester, wherein the thermochromatic layer is adapted to reversibly changes its color between an image concealable color and transparence in a predetermined temperature range, and wherein an image is formed in the thermochromatic layer and/or the resin layer through thermal transfer.

The base on which the image receptor surface according to the present invention is formed offers an interesting aesthetic effect such that the image in the image receptor surface is changed as described above and the latent image can readily be formed on the base. In the present invention, the image receptor surface is generally formed on the base for use thereof. In accordance with the present invention, there is provided a base on which an image receptor surface having a thermochromatic layer is formed. In accordance with still another preferred embodiment of the present invention, there is provided a base having an image receptor surface which receives an image of a sublimation dye thermally transferred thereto from a foundation sheet for formation of the image therein, wherein the image receptor surface comprises a thermochromatic layer which reversibly changes its color between an image concealable color and transparence in a predetermined temperature range.

An image of a sublimation dye may thermally be transferred to the thermochromatic layer of the image receptor surface formed on the base for formation of the image in the thermochromatic layer. In accordance with yet other preferred embodiments of the present invention, there are provided: a base having an image receptor surface which comprises a thermochromatic layer and a resin layer, wherein an image is formed in the thermochromatic layer and/or the resin layer; and a base having an image receptor surface which is adapted to receive an image of a sublimation dye thermally transferred thereto from a foundation sheet for formation of the image therein and comprises a thermochromatic layer, wherein the thermochromatic layer reversibly changes its color between an image concealable color and transparence in a predetermined temperature range, and wherein the thermally transferred image is formed in the thermochromatic layer.

In the aforesaid bases, i.e., the bases in which the thermally transferred image is formed in the thermochromatic layer of the image receptor surface and the bases in which the thermally transferred image is not formed in the thermochromatic layer of the image receptor surface, the thermochromatic layer are preferably formed of a thermochromatic ink. As described above, the thermochromatic layer or the thermochromatic ink to be used for formation of the thermochromatic layer preferably contains an epoxy resin and/or an epoxy acrylate resin, and may further contain an acryl resin and/or a polyester. In accordance with still another preferred embodiment of the present invention, there is provided a base having an image receptor surface which comprises a thermochromatic layer containing an epoxy resin and/or an epoxy acrylate resin.

In accordance with yet another preferred embodiment of the present invention, there is provided a base having an image receptor surface which comprises a thermochromatic layer and a resin layer. More preferably, the thermochromatic layer is formed on the resin layer. The thermochromatic layer formed on the resin layer may entirely or partially cover the resin layer.

The resin layer preferably contains an epoxy resin and/or an epoxy acrylate resin and an acryl resin and/or a polyester.

In accordance with still another preferred embodiment of the present invention, the base which has an image receptor surface adapted to receive an image of a sublimation dye thermally transferred thereto from a foundation sheet for formation of the image therein and comprising a thermochromatic layer adapted to reversibly change its color between an image concealable color and transparence in a predetermined temperature range, or which has an image receptor surface adapted to receive an image of a sublimation dye thermally transferred thereto from a foundation sheet for formation of the image therein and comprising a thermochromatic layer adapted to reversibly change its color between an image concealable color and transparence in a predetermined temperature range wherein the thermally transferred image is formed in the thermochromatic layer is characterized in that: the thermochromatic layer is a layer of a thermochromatic ink; the thermochromatic layer contains an epoxy resin and/or an epoxy acrylate resin; the image receptor surface comprises a resin layer as well as the thermochromatic layer, wherein the thermochromatic layer is formed on the resin layer; the image receptor surface comprises a resin layer as well as the thermochromatic layer, wherein the thermochromatic layer is formed on the resin layer and contains an epoxy resin and/or an epoxy acrylate resin, and wherein the resin layer contains an epoxy resin and/or an epoxy acrylate resin and an acryl resin and/or a polyester; the image receptor surface comprises a resin layer as well as the thermochromatic layer, wherein the thermochromatic layer is formed on the resin layer to partially cover the resin layer and contains an epoxy resin and/or an epoxy acrylate resin, and wherein the resin layer contains an epoxy resin and/or an epoxy acrylate resin and an acryl resin and/or a polyester; the image receptor surface comprises a resin layer as well as the thermochromatic layer, wherein the thermochromatic layer is formed on the resin layer and contains an epoxy resin and/or an epoxy acrylate resin, wherein the resin layer contains an epoxy resin and/or an epoxy acrylate resin and an acryl resin and/or a polyester, and wherein the thermally transferred image is formed in the thermochromatic layer and/or the resin layer; or the image receptor surface comprises a resin layer as well as the thermochromatic layer, wherein the thermochromatic layer is formed on the resin layer to partially cover the resin layer and contains an epoxy resin and/or an epoxy acrylate resin, wherein the resin layer contains an epoxy resin and/or an epoxy acrylate resin and an acryl resin and/or a polyester, and wherein the thermally transferred image is formed in the thermochromatic layer and/or the resin layer.

The base or the article on which the image receptor surface is formed is not particularly limited, but may be formed of any of various materials such as metals, wood materials, glass materials, ceramics, plastics, fabrics and fibrous materials for any applications. One exemplary base to be used in the present invention is a mug. The image receptor surface according the present invention is formed on the mug. When a hot drink is poured in the mug, the color of the image receptor surface of the present invention is changed by the heat, so that an image (such as letters and the like) preliminarily formed in the image receptor surface appears to offer an amusing effect. In accordance with yet another preferred embodiment of the present invention, there is provided a mug having an image receptor surface which is adapted to receive an image of a sublimation dye thermally transferred thereto from a foundation sheet for formation of the image therein and comprises a thermochromatic layer adapted to reversibly change its color between an image concealable color and transparence in a predetermined temperature range.

The image receptor surface formed on the mug may be any of those according to the preferred embodiments described above. In accordance with still another preferred embodiment of the present invention, the mug is characterized in that: the thermochromatic layer is a layer of a thermochromatic ink; the thermochromatic layer contains an epoxy resin and/or an epoxy acrylate resin; the image receptor surface comprises a resin layer as well as the thermochromatic layer, wherein the thermochromatic layer is formed on the resin layer; the image receptor surface comprises a resin layer as well as the thermochromatic layer, wherein the thermochromatic layer is formed on the resin layer and contains an epoxy resin and/or an epoxy acrylate resin, and wherein the resin layer contains an epoxy resin and/or an epoxy acrylate resin and an acryl resin and/or a polyester; or the image receptor surface comprises a resin layer as well as the thermochromatic layer, wherein the thermochromatic layer is formed on the resin layer to partially cover the resin layer and contains an epoxy resin and/or an epoxy acrylate resin, and wherein the resin layer contains an epoxy resin and/or an epoxy acrylate resin and an acryl resin and/or a polyester. These preferred embodiments for the mug correspond to the preferred embodiments for the image receptor surface.

Of course, the thermochromatic layer and/or the resin layer of the image receptor surface formed on the mug may be adapted to receive the image of the sublimation dye thermally transferred thereto, and the image may be formed in the thermochromatic layer and/or the resin layer of the image receptor surface. In accordance with yet another preferred embodiment of the present invention, there is provided a mug having an image receptor surface which is adapted to receive an image of a sublimation dye thermally transferred thereto from a foundation sheet for formation of the image therein and comprises a thermochromatic layer adapted to reversibly change its color between an image concealable color and transparence in a predetermined temperature range, wherein the thermally transferred image is formed in the thermochromatic layer.

In accordance with yet another preferred embodiment of the present invention, the mug which carries the thermally transferred image formed in the image receptor surface having the thermochromatic layer is characterized in that: the thermochromatic layer is a layer of the thermochromatic ink; the thermochromatic layer contains an epoxy resin and/or an epoxy acrylate resin; the image receptor surface comprises a resin layer as well as the thermochromatic layer, wherein the image is formed in the thermochromatic layer and/or the resin layer; the image receptor surface comprises a resin layer as well as the thermochromatic layer, wherein the thermochromatic layer is formed on the resin layer and contains an epoxy resin and/or an epoxy acrylate resin, wherein the resin layer contains an epoxy resin and/or an epoxy acrylate resin and an acryl resin and/or a polyester, and wherein the thermally transferred image is formed in the thermochromatic layer and/or the resin layer; or the image receptor surface comprises a resin layer as well as the thermochromatic layer, wherein the thermochromatic layer is formed on the resin layer to partially cover the resin layer and contains an epoxy resin and/or an epoxy acrylate resin, wherein the resin layer contains an epoxy resin and/or an epoxy acrylate resin and an acryl resin and/or a polyester, and wherein the thermally transferred image is formed in the thermochromatic layer and/or the resin layer.

In accordance with the present invention, there is provided a method of forming on a surface of a base an image receptor surface having a thermochromatic layer and adapted to receive an image of a sublimation dye thermally transferred thereto from a foundation sheet for formation of the image therein, the method comprising the step of applying an thermochromatic ink on the surface of the base. With the image receptor surface forming method, the image receptor surface can readily be formed on any of various bases at a lower cost. There is also provided a method of forming on a surface of a base an image receptor surface having a thermochromatic layer and a resin layer and adapted to receive an image of a sublimation dye thermally transferred thereto from a foundation sheet for formation of the image therein, the method comprising the steps of applying a synthetic resin on the surface of the base for formation of the resin layer and applying a thermochromatic ink on the resin layer for formation of the thermochromatic layer.

In the image receptor surface forming method described above, the formation of the thermochromatic layer may be achieved by thermally transferring the thermochromatic ink onto the surface of the base for the formation of the image receptor surface.

In accordance with the present invention, there is also provided a method of forming an image in an image receptor surface having a thermochromatic layer, the method comprising the step of thermally transferring an image of a sublimation dye to the thermochromatic layer from a foundation sheet to form the image in the thermochromatic layer. Since the image forming method achieves the image formation by thermal transfer of the sublimation dye, the image formation in the image receptor surface is facilitated. Therefore, any of various images can readily be formed in the image receptor surface at home.

As described above, the image receptor surface may comprise the resin layer as well as the thermochromatic layer, and the sublimation dye is received by the thermochromatic layer and/or the resin layer. In accordance with the present invention, there is also provided a method of forming an image in an image receptor surface having a resin layer and a thermochromatic layer formed on the resin layer, the method comprising the step of thermally transferring an image of a sublimation dye to the thermochromatic layer and/or the resin layer from a foundation sheet to form the image therein.

In accordance with the present invention, there are also provided: a method of forming an image in an image receptor surface having a thermochromatic layer, the method comprising the steps of applying a thermochromatic ink on a surface of a base for formation of the thermochromatic layer, and thermally transferring an image of a sublimation dye to the thermochromatic layer from a foundation sheet to form the image in the thermochromatic layer; and a method of forming an image in an image receptor surface having a resin layer and a thermochromatic layer formed on the resin layer, the method comprising the steps of applying a synthetic resin on a surface of a base for formation of the resin layer, applying a thermochromatic ink on the resin layer for formation of the thermochromatic layer, and thermally transferring an image of a sublimation dye to the thermochromatic layer and/or the resin layer from a foundation sheet to form the image therein.

In the present invention, an image of a sublimation dye is thermally transferred to an image receptor surface from a foundation sheet. The image to be transferred has been previously printed on the foundation sheet. As in the prior art, a paper sheet, a resin sheet (e.g., a thermoplastic resin sheet such as a polyester sheet) or the like is used as the foundation sheet, and an azo, anthraquinone or like recording agent which has a highly sublimate property is used as the sublimation dye. The foundation sheet and the sublimation dye recording agent are not limited to those described above. In the present invention, a transfer sheet to be used for the thermal image transfer is preferably prepared by printing an image on the foundation sheet with the sublimation dye by means of a video printer.

The image receptor surface according to the present invention comprises a thermochromatic layer. The color of the thermochromatic layer is not particularly limited, but the thermochromatic layer may be colored by a thermochromatic colorant composition so as to exhibit an image concealable background color (e.g., black or gray) at ordinary temperature (e.g., at about 20° C. to about 25° C.) and, when heated, for example, to a temperature of 50° C. to 100° C., exhibit an image nonconcealable background color (e.g., transparent or translucent color). The term "image concealable background color" is herein meant by a color that is capable of chromatically concealing the image formed in the image receptor surface, and the term "image nonconcealable background color" is herein meant by a color that does not chromatically conceal the image formed in the image receptor surface. In this connection, the thermochromatic layer of the image receptor surface of the present invention is preferably capable of reversibly changing its color between the image concealable background color at ordinary temperature and the image nonconcealable background color at a higher temperature, but may be an irreversibly color changing layer. The temperature of the color transition between the image concealable background color and the image nonconcealable background color is not particularly limited, but the image receptor surface preferably exhibits the image concealable background color at ordinary temperature and the image nonconcealable background color when heated. The formation of the thermochromatic layer of the image receptor surface may be achieved by using a known thermochromatic ink as which will be described later.

If the thermochromatic ink has two or more different color transition temperatures, the image receptor surface is capable of exhibiting one image nonconcealable background color at a temperature within a predetermined temperature range and another image nonconcealable background color at a temperature higher than the predetermined temperature range.

In the present invention, at least one thermochromatic layer is formed on a surface of a base. If the image receptor surface has two or more thermochromatic layers, the image receptor surface can exhibit two or more different colors at a particular temperature so as to control the appearance of the image. For enhancement of the adhesion of the image receptor surface to the surface of the base, the image receptor surface may be of a plural-layer structure, and a resin layer or a nonthermochromatic resin layer having a higher adhesion to the surface of the base may be interposed between the thermochromatic layer and the base.

Any of various known thermochromatic compositions (compositions containing thermochromatic coloring agents, e.g., thermochromatic pigments) can be used as the thermochromatic colorant composition to be contained in the thermochromatic ink. These thermochromatic compositions may be used either alone or as a mixture. The thermochromatic colorant composition is preferably a reversible thermochromatic composition. The thermochromatic composition may be used in combination with any other known coloring agents.

In general, the reversible thermochromatic composition comprises an electron donative color organic compound (color former), an electron acceptant compound (color developer) and a desensitizer. The reversible thermochromatic composition to be used is not particularly limited, but any of various known reversible thermochromatic compositions may be used.

Examples of specific thermochromatic compositions include TC POWDER BLACK (trade name) available from SAKURA COLOR PRODUCTS CORPORATION, TC POWDER RED (trade name) available from SAKURA COLOR PRODUCTS CORPORATION. and the like.

The thermochromatic composition (reversible thermochromatic composition) may be used in a microcapsule form (i.e., the thermochromatic composition is encapsulated in microcapsules). The amount of the thermochromatic composition to be used is not particularly limited. Where the thermochromatic ink contains a synthetic resin (which will be described later), for example, the thermochromatic composition is used in an amount of about 5 parts to about 200 parts by weight, preferably about 5 parts to 70 parts by weight, more preferably about 20 parts to about 70 parts by weight, with respect to 100 parts by weight of the synthetic resin. If the amount of the thermochromatic composition is greater than the aforesaid range, it is difficult for the resulting thermochromatic layer to exhibit a satisfactory adhesion to the surface of the base. If the amount is smaller than the aforesaid range, it is difficult for the resulting thermochromatic layer to exhibit a satisfactory image concealing power at ordinary temperature.

For formation of the thermochromatic layer on the surface of the base, a synthetic resin may be used as a component of the thermochromatic ink to enhance an image receptive ability of the thermochromatic layer. Used as the synthetic resin is at least one resin selected from the group consisting of thermosetting resins, UV-curing resins and thermoplastic resins. Particularly, a synthetic resin (a thermosetting resin, a UV-curing resin or a thermoplastic resin) having an excellent adhesion to the surface of the base is preferred. The aforesaid synthetic resins may be used either alone or in combination.

The use of a thermosetting resin ensures more easy formation of a thermally stable image receptor surface than the use of a thermoplastic resin. Since the image receptor surface on the base is repeatedly subjected to heating and cooling in accordance with the present invention, it is preferred to use the thermosetting resin.

The thermosetting resin to be blended is not particularly limited, but examples thereof include epoxy resins, epoxy acrylate resins, thermosetting acryl resins, thermosetting polyesters (e.g., unsaturated polyesters), thermosetting polyurethane resins, and thermosetting urethane acrylate resins, among which an epoxy resin and/or an epoxy acryl resin (particularly, an epoxy resin) are preferred.

Examples of specific epoxy resins include bisphenol A epoxy resins, bisphenol F epoxy resins, novolac epoxy resins, brominated epoxy resins and polyglycol epoxy resins. In the present invention, a bisphenol A epoxy resin is particularly preferred which has a number-average molecular weight of about 200 to about 5,000 with an epoxy equivalent (a ratio of the number-average molecular weight thereof to the number of epoxy groups in one molecule thereof) being about 100 to about 1,000. Particularly, a bisphenol A epoxy resin having an epoxy equivalent of about 100 to about 500 is preferred because such an epoxy resin is in liquid phase at ordinary temperature. An epoxy resin having an epoxy equivalent of 500 to 1,000 may be diluted with an diluent for use.

Examples of preferable epoxy acrylate resins include those derived from any of the aforesaid epoxy resins by esterification thereof with acrylic acid for modifying the functional groups (epoxy groups) into acryloyl groups. In an epoxy acrylate resin, the ratio of the epoxy groups to the acryloyl groups is not particularly limited.

Where the thermosetting resin is used as the resin component of the thermochromatic ink, a catalyst or a promotor may be used for curing the thermosetting resin. Particularly, where the epoxy resin and/or the epoxy acrylate resin (hereinafter referred to as "epoxy-based resins" when used in combination) are used, it is preferred to use, in combination, a first curing agent which reacts with the epoxy-based resins at ordinary temperature for curing thereof and a second curing agent which reacts with the epoxy-based resins at 80° C. to 200° C. for curing thereof.

The use of the first curing agent and the second curing agent is not critical The first curing agent moderately reacts with the epoxy resins at ordinary temperature (at about 10° C. to about 30° C.) for curing a surface portion of the thermochromatic layer so as to facilitate the subsequent operations. Usable as the first curing agent are aliphatic amines, alicyclic amines, aromatic amines, amine adducts, acid anhydrides and polyamides, which may be used either alone or in combination.

Examples of preferable aliphatic amines include diethylenetriamine, triethylenetetramine, N-aminoethyl piperazine and diethylaminopropylamine. Examples of preferable alicyclic amines include isophorone amine, 3,9-bis(3-aminopropyl)-2,4,8,10-tetraoxaspiro[5,5]undecane, 1,3-bisaminomethylhexane and m-xylylenediamine. Examples of preferable aromatic amines include metaphenylenediamine, diaminodiphenylmethane, diaminodiphenyl sulfone and toluylenediamine.

Examples of preferable amine adducts include those obtained by reacting any of the aforesaid amines with an epoxy resin having a reactivity therewith.

Examples of preferable polyamides include polyamide 6 and polyamide 66.

Examples of preferable acid anhydrides include aromatic acid anhydrides such as phthalic anhydride, methyltetrahydrophthalic anhydride and trimellitic anhydride, cyclic fatty acid anhydrides such as maleic anhydride, succinic anhydride, tetrahydrophthalic anhydride, methylnadic anhydride, alkenylsuccinic anhydrides and hexahydrophthalic anhydride, aliphatic acid anhydrides such as polyadipic anhydride and polyazelaic anhydride, and halogenated acid anhydrides such as chlorendic anhydride and tetrabromophthalic anhydride.

The first curing agent may be either in liquid phase or in solid phase as long as it reacts with the epoxy-based resins at ordinary temperature. Among the aforesaid curing agents as the first curing agent, the amine adducts and polyamides are more preferable. More preferably, the first curing agent is in liquid phase at ordinary temperature with an active hydrogen equivalent (a ratio of the molecular weight thereof to the number of active hydrogen atoms in one molecule thereof) being about 20 to about 600. In definition of the active hydrogen equivalent, the molecular weight of a resin as the curing agent is a number-average molecular weight.

The second curing agent reacts with the epoxy-based resins under a high temperature condition, e.g., at a temperature of about 80° C. to about 200° C. to cure the thermochromatic layer completely or almost completely. Usable as the second curing agent are those known to be commonly used as a potential epoxy resin curing agent. Examples of specific curing agents to be used as the second curing agent include dicyandiamide and derivatives thereof, organic acid hydrazides, imidazoles, trifluoroboron-amine complexes and the like, which may be used either alone or in combination.

Exemplary dicyandiamide derivatives include dicyandiamide, o-tolylbiguanide, phenylbiguanide, α-benzylbiguanide, α-2,5-dimethylbiguanide and phenylbiguanide oxalate.

Examples of specific organic acid hydrazides include succinic hydrazide, adipic hydrazide and p-oxybenzoic hydrazide.

Examples of specific imidazoles include 2-heptadecylimidazole, 1-cyanoethyl-4-methylimidazole and 2-methylimidarium isocyanate.

Examples of specific trifluoroboron ($BF_3$)-amine complexes include a $BF_6$ complex of monomethylamine, a $BF_3$ complex of n-hexylamine and a $BF_3$ complex of triethylamine.

Also usable as the second curing agent are microcapsules which contain at least one selected from the group consisting of amine adducts having a melting point of 80° C. or higher, diallylmelamine and curing agents which has a reactivity at ordinary temperature, and function as the curing agent when their shells are broken at 80° C. or higher.

Among the aforesaid curing agents as the second curing agent, dicyandiamide and its derivatives, the organic acid hydrazides and the amine adducts having a melting point of 80° C. or higher are more preferable.

Where the thermosetting resin, particularly the epoxy-based resins (an epoxy resin and/or an epoxy acrylate resin), are used in combination with the thermoplastic resin (particularly, an acryl resin and/or a polyester) as the resin component of the thermochromatic ink for formation of the thermochromatic layer of the image receptor surface, the sublimation dye can readily penetrate into the thermochromatic layer. More specifically, the thermoplastic resin (the acryl resin and/or polyester) is blended with the thermosetting resin in consideration of the fixability of the thermally transferred sublimation dye in the thermochromatic layer. The acryl resin and/or polyester are preferably blended, for example, in an amount of about 5 to about 500 parts by weight relative to 100 parts by weight of the epoxy-based resins or the thermosetting resin. If the amount of the thermoplastic resin to be blended is smaller than the aforesaid range, the fixability of the thermally transferred dye may be deteriorated, and the resulting thermochromatic layer may be less durable. If the amount of the thermoplastic resin is greater than the aforesaid range, the resulting thermochromatic layer cannot sufficiently be cured, so that the thermochromatic layer becomes less adhesive to the surface of the base and hence less durable.

Examples of specific acryl resins to be used in combination with the thermosetting resin include, in a broader sense, polyacrylic acid, polyacrylates such as ethyl polyacrylate and methyl polyacrylate, polyacrylonitrile, and polymethacrylates such as methyl polymethacrylate. Examples of specific polyesters to be used in combination with the thermosetting resin include polyethylene terephthalate, polybutylene terephthalate and polyesters such as obtained through ring opening polymerization of an alkyd resin and lactone.

Any of various known UV-curing resins can be used as the resin component of the thermochromatic ink in accordance with the present invention. For example, a UV-curing resin disclosed in Japanese Unexamined Patent Publication No. 8-48923 (1996) may be used. In accordance with the present invention, the use of the UV-curing resin is preferable because the UV-curing resin ensures formation of a thermally stable thermochromatic layer like the thermosetting resin.

The thermoplastic resin to be used as the resin component of the thermochromatic layer in the present invention is not particularly limited. Examples of preferable thermoplastic resins include thermoplastic polyesters, thermoplastic acryl resins, polyvinyl chloride and polyvinylidene chloride, and products obtained by modification thereof. Since the image receptor surface of the present invention is repeatedly subjected to heating, the thermoplastic resin to be blended preferably has an excellent heat resistance. The thermoplastic resin is required to have a glass transition temperature higher than the color transition temperature of the thermochromatic layer. The glass transition temperature of the thermoplastic resin is not particularly limited, but may properly be selected depending on the application of the image receptor surface.

In the present invention, any of various known additives such as a reactive diluent, a filler pigment, an adhesion promotor and an anti-foaming agent may be blended with the thermochromatic ink composition as required.

The reactive diluent to be blended is not particularly limited, but examples thereof include glycidyl versadate, phenyl glycidyl ether, allyl glycidyl ether and n-butyl glycidyl ether. The amount of the reactive diluent to be blended is not particularly limited. Where the thermosetting resin, e.g., the epoxy-based resin, is used as the resin component of the thermochromatic ink composition, for example, the reactive diluent is preferably blended in an amount of about 5 to about 30 parts by weight, more preferably 5 to 10 parts by weight with respect to 100 parts by weight of the thermosetting resin.

The filler pigment to be blended is not particularly limited, but examples thereof include silica, alumina, alumina silicate, calcium carbonate, mica and quartz powder. The amount of the filler pigment to be blended is not particularly limited, but may be such that the flow of the ink composition can be properly controlled. Where the thermosetting resin, e.g., the epoxy-based resin, is used as the resin component of the thermochromatic ink composition, for example, the filler pigment is blended in an amount of about 2 to about 20 parts by weight, more preferably 2 to 4 parts by weight with respect to 100 parts by weight of the thermosetting resin.

The adhesion promotor to be blended is not particularly limited, but examples thereof include silane-based coupling agents such as γ-glycidoxypropyltrimethoxysilane, N-β(aminoethyl)-aminopropyltrimethoxysilane, β-(3,4-epoxycyclohexyl)-ethyltrimethoxysilane, and γ-chloropropyltrimethoxysilane. The amount of the adhesion promotor to be blended is not particularly limited. Where the thermosetting resin, e.g., the epoxy-based resin is used as the resin component of the thermochromatic ink composition, for example, the adhesion promotor is blended in an amount of 0.05 to 5 parts by weight, more preferably 0.07 to 3 parts by weight with respect to 100 parts by weight of the thermosetting resin.

The anti-foaming agent to be blended is not particularly limited, but examples thereof include known siloxane-based anti-foaming agents such as polyether-modified methylalkylpolysiloxanes and polyester-modified polydimethylsiloxanes. The amount of the anti-foaming agent to be blended is not particularly limited. Where the thermosetting resin, e.g., the epoxy-based resin, is used as the resin component of the thermochromatic ink composition, for example, the anti-foaming agent is blended in an amount of about 0.05 to 5 parts by weight, more preferably 0.07 to 3 parts by weight with respect to 100 parts by weight of the thermosetting resin.

In the present invention, the method of preparing the thermochromatic ink composition is not particularly limited. For example, the thermochromatic ink composition can be prepared by mixing the ingredients described above (the thermochromatic colorant composition, the synthetic resin and the additives) by an ordinary method.

As described above, the image receptor surface according to the present invention has the thermochromatic layer. The thermochromatic layer may form the entire image receptor surface or part of the image receptor surface. Where the thermochromatic layer forms the entire image receptor surface, the thermochromatic layer may function as an image receptor, i.e., have the function of receiving the sublimation dye thermally transferred thereto.

The image receptor surface may have a resin layer which is capable of receiving the sublimation dye thermally transferred thereto, so that the resin layer functions as the image receptor. In the image receptor surface having the resin layer, the thermochromatic layer may also have the function as the image receptor, but it is not critical for the thermochromatic layer to have the function as the image receptor. If the thermochromatic layer has the function of receiving the sublimation dye, the thermochromatic layer preferably contains the synthetic resin.

Where the thermochromatic layer partially forms the image receptor surface, either a single thermochromatic layer or a plurality of thermochromatic layers are provided in the image receptor surface. In this case, the image receptor surface includes the thermochromatic layer as well as the resin layer. Whether the thermochromatic layer forms the entire image receptor surface or part of the image receptor surface, the resin layer may be formed in the image receptor surface. In most cases, the thermochromatic layer is formed on the resin layer in accordance with the present invention.

The resin layer of the image receptor surface may be formed of any of the aforesaid synthetic resins (thermosetting resins, UV-curing resins and thermoplastic resins) which are used as the resin component of the thermochromatic ink composition for the formation of the thermochromatic layer. These synthetic resins may be used either alone or in combination. It is preferred to use as the synthetic resin any of the aforesaid thermosetting resins (e.g., epoxy-based resins) and any of the aforesaid thermoplastic resins (e.g., acryl resins and polyesters) in combination. A combination of an epoxy-based resin and an acryl resin is more preferable, and a combination of an epoxy resin and an acryl resin is particularly preferable.

Where the image receptor surface has the resin layer, the arrangement of the thermochromatic layer and the resin layer is not particularly limited. That is, it is not critical which of the thermochromatic layer and the resin layer is provided in contact with the surface of the base. For example, the resin layer and the thermochromatic layer may be formed in this order on the base. Alternatively, the thermochromatic layer and the resin layer are formed in this order on the base, or the resin layer, the thermochromatic layer and the resin layer may be formed in this order on the base. However, the image receptor surface is preferably of a double layer structure consisting of the resin layer and the thermochromatic layer formed in this order on the base. Where the thermochromatic layer forms part of the image receptor surface, possible arrangements of the thermochromatic layer and the resin layer are such that the thermochromatic layer is formed on the resin layer to partially cover the resin layer formed on the base, and such that the thermochromatic layer is formed on the base and extensively covered with the resin layer. The resin layer and the thermochromatic layer may each be a laminate consisting of a plurality of resin-containing layers. Where the resin layer is formed directly on the base, the resin layer is preferably composed of a resin which is adhesive to the base.

Where the image receptor surface of the present invention comprises the thermochromatic layer alone, the formation of the thermochromatic layer can be achieved by applying the thermochromatic ink composition on the surface of the article or the base. Where the image receptor surface comprises the resin layer and the thermochromatic layer, the formation of the image receptor surface can be achieved by applying the thermochromatic ink composition and the synthetic resin on an application surface (on the surface of the base, the thermochromatic layer or the resin layer). The formation of the thermochromatic layer may otherwise be achieved by a thermal transfer method employing a transfer paper or a transfer sheet on which the thermochromatic ink is applied.

In the present invention, the formation of the thermochromatic layer and/or the resin layer is, in general, achieved by a printing method using the thermochromatic ink composition and the synthetic resin. Any printing methods such as a screen printing method may be employed for applying the thermochromatic ink composition or the synthetic resin on an application surface (on the surface of the base, the thermochromatic layer or the resin layer). Where the thermosetting resin is use as the resin component of the thermochromatic ink composition or as the synthetic resin for the resin layer, the applied ink composition or the applied resin is heated for curing thereof. Where the UV-curing resin is used as the resin component of the thermochromatic ink composition or as the synthetic resin for the resin layer, the applied ink composition or the applied resin is exposed to ultraviolet radiation for curing thereof.

Where the image receptor surface is of a plural-layer structure consisting of two or more layers (resin and thermochromatic layers), the formation of the respective layers is achieved by repeating the aforesaid ink or resin application operation a required number of times. If the layers each contain the thermosetting resin or the UV-curing resin, it is preferred that the layers are each formed after an underlying layer is cured by application of heat or ultraviolet radiation.

The thermochromatic resin layer to be formed as an uppermost layer, an intermediate layer or a lowermost layer (preferably as the uppermost layer) preferably exhibits a thick color having a high concealing power so that the image formed in the image receptor surface can be concealed. More preferably, the thermochromatic layer is black or navy blue at ordinary temperature, and turns achromatically or chromatically transparent or substantially transparent at a color transition temperature.

The thickness of the image receptor surface to be formed on the surface of the base may properly be selected depending on the structure of the image receptor surface, but is preferably 10 $\mu$m to 200 $\mu$m, more preferably 20 $\mu$m to 150 $\mu$m, particularly preferably 5 $\mu$m to 100 $\mu$m. If the thickness is smaller than 10 $\mu$m, pin holes may be formed in the image receptor surface, and uniform adhesion of the image receptor surface to the surface of the base cannot be ensured. If the thickness is greater than 200 $\mu$m, the image receptor surface may be bumpy and, hence, have variations in thickness.

Where the image receptor surface has the resin layer as well as the thermochromatic layer, the thicknesses of the thermochromatic layer and the resin layer are not particularly limited, but may properly be selected so that the total thickness is within the aforesaid thickness range for the image receptor surface. Where the image receptor surface has a plurality of resin layers and a plurality of thermochromatic layers, the thicknesses of the respective layers are not particularly limited, but may properly be selected so that the total thickness is within the aforesaid thickness range for the image receptor surface. Where the image receptor surface is of a double layer structure consisting of the thermochromatic layer and the resin layer which are formed in this order on the base and both function as the image receptor layer, for example, the resin layer preferably has a thickness of 5 μm to 50 μm (more preferably 10 μm to 40 μm) and the thermochromatic layer preferably has a thickness of 10 μm to 150 μm (more preferably 50 μm to 100 μm).

A baking temperature at which the synthetic resin applied on the surface of the base is baked is properly determined depending on the type of the synthetic resin. More specifically, the baking temperature is properly selected depending on the softening temperature and curing temperature of the synthetic resin. In general, the baking temperature is preferably 100° C. to 200° C.

As previously described, the material for the base or article to which the present invention is applicable is not particularly limited. Exemplary materials for the base include glass materials, ceramics, metals, synthetic resins, porcelain enamels, paper materials and wood materials. Examples of specific articles include tableware such as mugs, glasses, cups, dishes and plates, tiles, synthetic resin films and sheets, paper sheets and fabrics, among which the mugs are particularly preferred.

The color of the surface of the base (or color painting on the surface of the base) is not particularly limited. However, it is not preferred that, when the image receptor surface turns transparent or into a pale color so that the image of the transferred sublimation dye appears in the image receptor surface, the image is concealed by the color of the surface of the base underlying the image receptor surface. Where the image receptor surface is non-transparent or has a non-pale color at ordinary temperature and is adapted to turn transparent or into a pale color when heated, the color of the surface of the base or the color painting on the surface of the base is not particularly limited as long as the image appearing in the image receptor surface is not concealed thereby. The image receptor surface preferably has a thick color such as black at ordinary temperature. If an illustration or the like is directly painted on the surface of the base, the illustration on the surface of the base offers an interesting aesthetic effect cooperatively with the image appearing in the image receptor surface when the image receptor surface turns transparent or into a pale color.

In the present invention, the formation of the image in the image receptor surface can be achieved by a common thermal transfer method. For example, an image transfer sheet is prepared by forming an image of a sublimation dye on a foundation sheet by a coating or printing method, and a surface of the image transfer sheet formed with the image of the sublimation dye is brought into contact with the image receptor surface and heated to thermally transfer the image to the image receptor surface for the formation of the image in the image receptor surface. When the image of the sublimation dye on the foundation sheet is brought into contact with the image receptor surface and heated, the sublimation dye is sublimed to be transferred to the image receptor surface. Thus, the image can be formed in the image receptor surface. The temperature at which the thermal transfer is performed is properly selected depending on the type of the sublimation dye.

Figure 2:
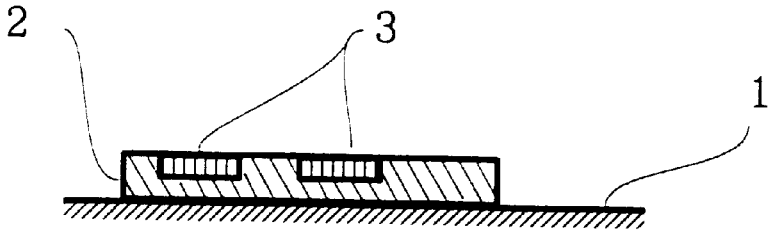
FIG. 2 is an enlarged schematic sectional view illustrating a state of the image receptor surface on the mug in which an image has been formed through thermal transfer.
Figure 3:
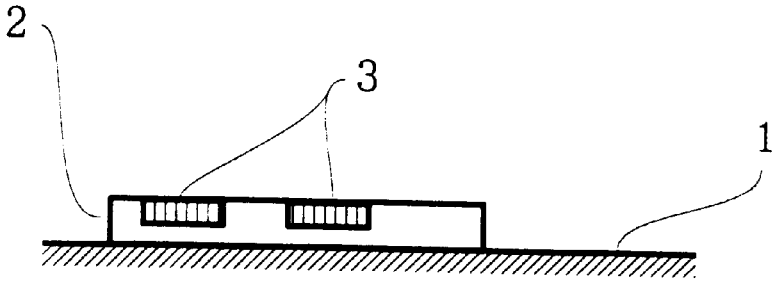
FIG. 3 is an enlarged schematic sectional view illustrating a state of the image receptor surface on the mug where the thermally transferred image appears in the image receptor surface when the image receptor surface becomes transparent.

FIG. 1 is an enlarged schematic sectional view illustrating an image receptor surface formed on a mug (base) in accordance with one embodiment of the present invention. In FIG. 1, there are shown a surface 1 of the mug, and the image receptor surface 2 which is of a single layer structure consisting of a thermochromatic layer and is formed partially on the surface 1 of the mug. FIG. 2 is an enlarged schematic sectional view illustrating a state of the image receptor surface 2 on the mug in which an image 3 has been formed through thermal transfer. FIG. 2 shows that the image 3 of a colorant composition transferred to the image receptor surface 2 penetrates into the image receptor surface 2 and is fixed therein. The image 3 is chromatically concealed by the color (e.g., black) of the image receptor surface 2 at ordinary temperature so that the image 3 is a latent image. When the mug on which the image receptor surface 2 formed with the image 3 is provided is heated, the image receptor surface 2 turns transparent, for example, as shown in FIG. 3, so that the latent image 3 of the colorant composition fixed in the image receptor surface 2 is made visible.

Figure 7:
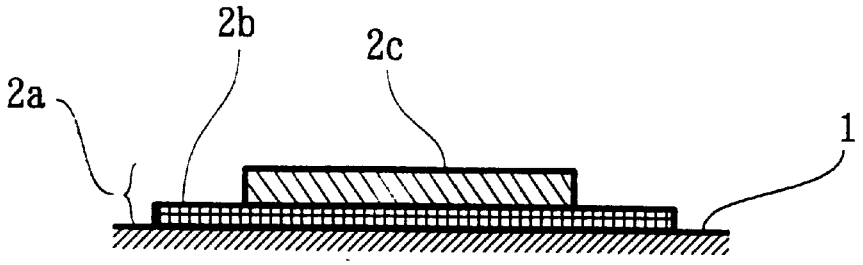
FIG. 7 is an enlarged schematic sectional view illustrating an image receptor surface formed on a mug (base) in accordance with another embodiment of the present invention.
Figure 8:
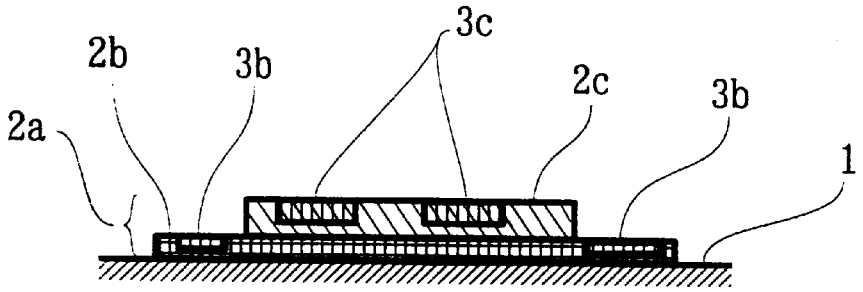
FIG. 8 is an enlarged schematic sectional view illustrating a state of the image receptor surface on the mug in which an image has been formed through thermal transfer.

Although the colorant composition penetrates into the thermochromatic layer of the image receptor surface and completely fixed therein in this embodiment, the image of the colorant composition may be formed outside the thermochromatic layer in the image receptor surface, if another layer (e.g., resin layer) is provided therein. FIG. 7 is an enlarged schematic sectional view illustrating an image receptor surface formed on a mug (base) in accordance with another embodiment of the present invention. In FIG. 7, there are shown a surface 1 of the mug, and the image receptor surface 2*a* comprising a resin layer 2*b* formed partially on the surface 1 of the mug and a thermochromatic layer 2*c* partially formed on the resin layer 2*b*. That is, the image receptor surface 2*a* shown in FIG. 7 is of a double layer structure consisting of the thermochromatic layer 2*c* and the resin layer 2*b*. FIG. 8 is an enlarged schematic sectional view illustrating a state of the image receptor surface 2*a* on the mug shown in FIG. 7 in which an image has been formed through thermal transfer. In FIG. 8, a colorant composition transferred to the image receptor surface 2*a* penetrates into the image receptor surface 2*a* and is fixed therein. In this case, portions 3*b* and 3*c* of an image of the colorant composition are received by the resin layer 2*b* and the thermochromatic layer 2*c*, respectively. Accordingly, the image of the colorant composition is formed not only in the thermochromatic layer 2*c* but also in the resin layer 2*b*. Although the image of the colorant composition is received by the thermochromatic layer 2*c* and the resin layer 2*b* in the embodiment shown in FIG. 8, the image may be received by at least either one of the thermochromatic layer 2*c* and the resin layer 2*b*.

Figure 9:
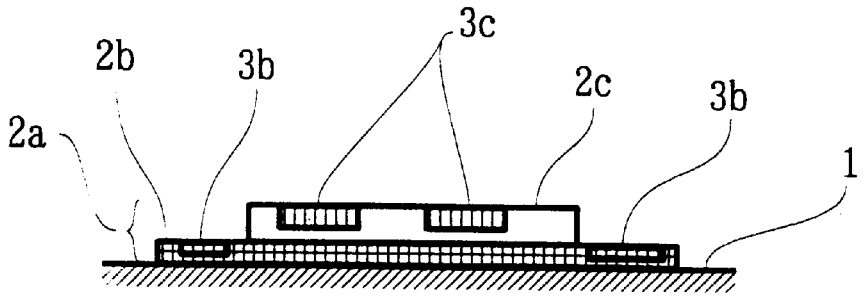
FIG. 9 is an enlarged schematic sectional view illustrating a state of the image receptor surface on the mug where the thermally transferred image appears in the image receptor surface when the image receptor surface becomes transparent.

As shown in FIG. 8, the image portion 3*c* formed in the thermochromatic layer 2*c* is chromatically concealed by the color (e.g., black) of the thermochromatic layer 2*c* at ordinary temperature, so that the image portion 3*c* in the thermochromatic layer 2*c* is latent. On the other hand, the image portion 3*b* formed in the resin layer 2*b* is not chromatically concealed. When the mug on which the image receptor surface 2*a* formed with the image is provided is heated, the thermochromatic layer 2*c* turns transparent, for example, as shown in FIG. 9, so that the latent image portion 3*c* in the thermochromatic layer 2*c* of the image receptor surface 2*a* is made visible thereby to offer an interesting aesthetic effect cooperatively with the image portion 3*b* formed in the image nonconcealable resin layer 2*b*.

EXAMPLES

The present invention will hereinafter be described in detail by way of examples thereof. It should be understood that the invention be not limited to these examples.

(1) Preparation of Image Transfer Sheet

Figure 4:
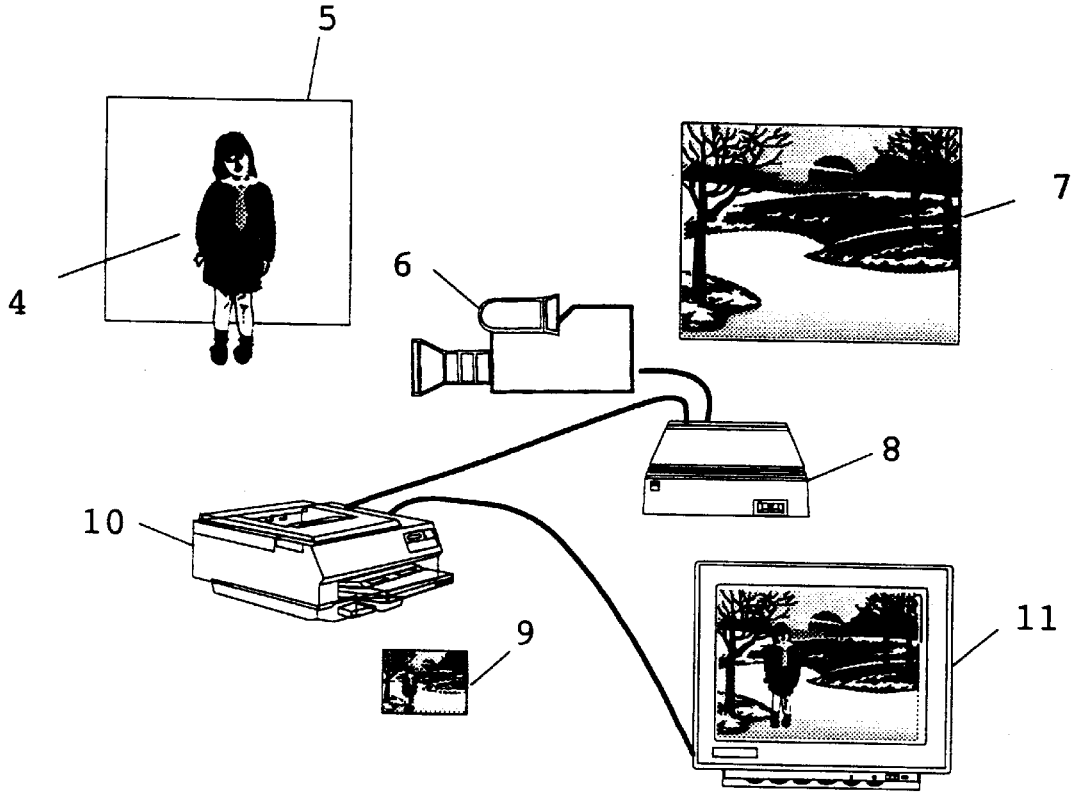
FIG. 4 is a diagram for explaining a process for producing a transfer sheet.

A process for preparing an image transfer sheet is shown in FIG. 4. An image of an object 4 in front of a screen 5 was picked up by means of an input camera 6, and an superimposition image 7 was picked up by means of a color video scanner 8 (UV-T55V available from Sony Co., Ltd.). The image of the object 4 was superimposed on the superimposition image 7, and the resulting image was printed as a reversal print image on a print paper sheet 9 with a sublimation dye recording agent by means of a color video printer 10 (UP-2200R available from Sony Co., Ltd.) for preparation of the image transfer sheet. The reversal print image was monitored on a monitor 11.

(2) Preparation of Thermochromatic Ink Compositions A to C

A method of preparing thermochromatic ink compositions to be used for formation of a thermochromatic layer of an image receptor surface will hereinafter be described. Thermochromatic ink compositions A to C were each prepared by blending a TC pigment (a thermochromatic pigment available from SAKURA COLOR PRODUCTS CORPORATION. under the trade name of "TC POWDER BLACK" or "TC POWDER RED") and other ingredients in a mixing ratio to be described later. More specifically, the ingredients other than the TC pigment were mixed together, and the resulting mixture was mixed with the TC pigment for the preparation of the thermochromatic ink compositions A to C.

The thermochromatic ink compositions A and B were two-part-curing-system ink compositions for screen printing. The thermochromatic ink compositions A and B each contained 20 parts by weight of a curing agent and 1 part by weight of an adhesion promotor relative to 75 parts by weight of a base component thereof. Used as the curing agent was an amine adduct (available from Yuka Shell Epoxy Kabushiki kaisha under the trade name of "EPICURE U" and having a hydrogen equivalent of about 47). Used as the adhesion promotor was a γ-chloropropyltrimethoxysilane-based adhesion promotor (available from Shinetsu Chemical Co., Ltd. under the trade name of "KBM703"). The thermochromatic ink compositions A and B each contained a silica-based filler pigment.

| | |
|---|---|
| (Thermochromatic ink composition A) | |
| Base component | |
| TC pigment 1 | 35 parts by weight |
| Epoxy resin | 60 parts by weight |
| Reactive diluent | 3.0 parts by weight |
| Anti-foaming agent 1 | 0.5 parts by weight |
| Filler pigment | 1.5 parts by weight |
| (Thermochromatic ink composition B) | |
| Base component | |
| TC pigment 2 | 35 parts by weight |
| Epoxy acryl resin | 60 parts by weight |
| Reactive diluent | 3.0 parts by weight |
| Anti-foaming agent 1 | 0.5 parts by weight |
| Filler pigment | 1.5 parts by weight |
| (Thermochromatic ink composition C) | |
| TC pigment 1 | 28.5 parts by weight |
| Photopolymerization initiator | 1.0 part by weight |
| Photopolymerizable prepolymer | 40.0 parts by weight |
| Photopolymerizable monomer | 30.0 parts by weight |
| Anti-foaming agent 2 | 0.5 parts by weight |

The TC pigments 1 and 2 (thermochromatic pigments), the resins (epoxy resin and epoxy acryl resin), the photopolymerizable prepolymer, the photopolymerizable monomer and the like used for preparation of the thermochromatic ink compositions A to C are as follows.

TC Pigment 1

Thermochromatic pigment available from Sakura Color Products Corporation under the trade name of "TC POWDER BLACK"

TC Pigment 2

Thermochromatic pigment available from Sakura Color Products Corporation under the trade name of "TC POWDER RED"

Epoxy Resin

Bisphenol A epoxy resin having an epoxy equivalent of 189 and available from Yuka Shell Epoxy Kabushiki kaisha under the trade name of "Epikote 828"

Epoxy acryl Resin

Bisphenol A epoxy acrylate having a number-average molecular weight of 1,100 and available from Nippon Kayaku Co., Ltd. under the trade name of "KAYARAD R-131"

Reactive Diluent

Available from Yuka Shell Epoxy Kabushiki kaisha under the trade name of "CARDURA E10" Photopolymerization initiator: 2,4,6-trimethylbenzoyldiphenylphosphineoxide Photopolymerizable Prepolymer Urethane acrylate available from Nippon Kayaku Co., Ltd. under the trade name of "KAYARAD UX-8101"

Photopolymerizable Monomer

Reaction product of neopentylglycol and hydroxypovalic acid available from Nippon Kayaku Co., Ltd. under the trade name of "KAYARAD MANDA"

Anti-foaming Agent 1

Ether-modified methylalkyl polysiloxane available from BYK Chemie Japan KK under the trade name of "Byk-070"

Anti-foaming agent 2

Silicone available from DOW CORNING TORAY SILICONE Co., LTD. under the trade name of "SH 200 OIL 100CS"

Example 1

Figure 5:
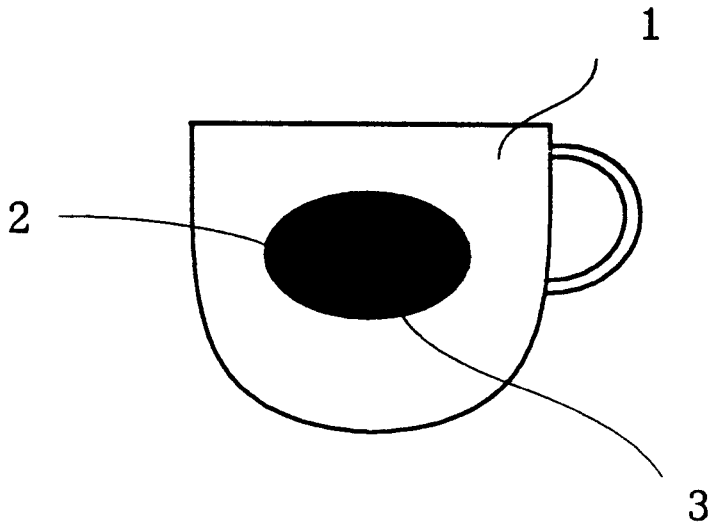
FIG. 5 is a diagram illustrating a state of the image receptor surface on the mug where an image formed in the image receptor surface through thermal transfer is concealed.
Figure 6:
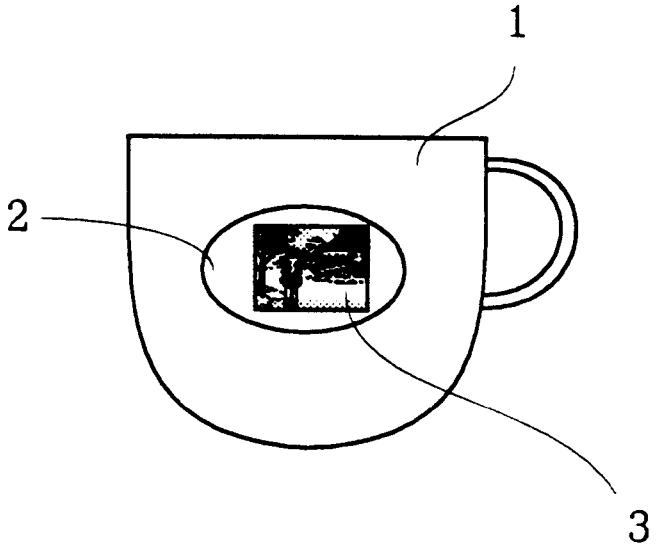
FIG. 6 is a diagram illustrating a state of the image receptor surface on the mug where the thermally transferred image appears in the image receptor surface when the image receptor surface becomes transparent.

The thermochromatic ink composition A was applied on a ceramic mug by a printing method, and then heated for curing the thermosetting resin in the ink composition. Thus, a thermochromatic image receptor surface was formed on the ceramic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the black image receptor surface. At ordinary temperature, the image was concealed by the black image receptor surface 2 and hence invisible as shown in FIG. 5. When 70° C. water was thereafter poured in the mug, the image receptor surface 2 turned transparent, so that the image 3 appeared in the image receptor surface as shown in FIG. 6. The thickness of the image receptor surface was 70 μm.

Example 2

The thermochromatic ink composition B was applied on a plastic mug by a printing method, and then heated for curing the thermosetting resin in the ink composition. Thus, a thermochromatic image receptor surface was formed on the plastic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the red image receptor surface. At ordinary temperature, the image was concealed by the red image receptor surface 2 and hence invisible as shown in FIG. 5. When 70° C. water was thereafter poured in the mug, the image receptor surface 2 turned transparent, so that the image 3 appeared in the image receptor surface as shown in FIG. 6. The thickness of the image receptor surface was 70 μm.

Example 3

The thermochromatic ink composition A was applied on a plastic mug by a printing method, and then heated for curing the thermosetting resin in the ink composition. Thus, a thermochromatic image receptor surface was formed on the plastic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the black image receptor surface 2 as shown in FIG. 5. At ordinary temperature, the image was concealed by the black image receptor surface 2 and hence invisible. When 70° C. water was thereafter poured in the mug, the image receptor surface 2 turned transparent, so that the image 3 appeared in the image receptor surface as shown in FIG. 6. The thickness of the image receptor surface was 70 $\mu$m.

Example 4

An ink transfer sheet was prepared by applying the thermochromatic ink composition A onto a PET film, and then the thermochromatic ink composition A was thermally transferred onto a ceramic mug from the ink transfer sheet. Thus, a thermochromatic image receptor surface was formed on the ceramic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the black image receptor surface 2. At ordinary temperature, the image was concealed by the black image receptor surface 2 and hence invisible as shown in FIG. 5. When 70° C. water was thereafter poured in the mug, the image receptor surface 2 turned transparent, so that the image 3 appeared in the image receptor surface as shown in FIG. 6. The thickness of the image receptor surface was 50 $\mu$m.

Example 5

The thermochromatic ink composition C was applied on a ceramic mug by a printing method, and then exposed to ultraviolet radiation for curing the UV-curing resin in the ink composition. Thus, a thermochromatic image receptor surface was formed on the ceramic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the black image receptor surface 2 as shown in FIG. 5. At ordinary temperature, the image 3 was concealed by the black image receptor surface 2 and hence invisible. When the mug was thereafter warmed by the palm of a hand, the image receptor surface 2 turned transparent, so that the image 3 appeared in the image receptor surface. The thickness of the image receptor surface was 60 $\mu$m.

Example 6

A mixture of an epoxy resin and an acryl resin was applied on a surface of a ceramic mug for formation of a resin layer on the surface of the mug. In turn, the thermochromatic ink composition A was applied onto the resin layer on the mug by a printing method, and then heated for curing the thermosetting resin in the ink composition. Thus, a thermochromatic image receptor surface was formed on the ceramic mug. A print surface of the image transfer sheet was brought into contact with the image receptor surface, and pressed at a pressure of 1 kg/cm$^2$ at 200° C. for 2 minutes by means of a hot press for thermal transfer of the image. The image of the sublimation dye penetrated into the black image receptor surface. At ordinary temperature, the image was concealed by the black image receptor surface 2 and hence invisible as shown in FIG. 5. When 70° C. water was thereafter poured in the mug, the image receptor surface 2 turned transparent, so that the image 3 appeared in the image receptor surface as shown in FIG. 6. Used as the epoxy resin for the resin layer was bisphenol A epoxy resin having an epoxy equivalent of 189 and available from Yuka Shell Epoxy Kabushiki kaisha under the trade name of "Epikote 828". Used as the acryl resin for the resin layer was DIANAL SE-5661 (trade name) available from Mitsubishi Chemical Co., Ltd. The weight ratio of the epoxy resin to the acryl resin for the resin layer was 1/9. The resin layer had a thickness of 20 $\mu$m and the thermochromatic layer (the layer formed of the thermochromatic ink composition A) had a thickness of 50 $\mu$m.

The properties of the image receptor surfaces of Examples 1 to 6 were examined by performing the following tests.

(Adhesion Test)

A cross-cut peel test with an adhesive cellophane tape was performed on the respective image receptor surfaces for evaluation of the adhesion of the image receptor surfaces. As a result, none of the image receptor surfaces of Examples 1 to 6 was peeled off, and none of the images thermally transferred to the image receptor surfaces was missing.

The cross-cut peel test with an adhesive cellophane tape was performed in conformity of JIS K5400.

(Hot Water Peel Resistance Test)

The mugs respectively formed with the image receptor surfaces were immersed in hot water at 80° C. for 10 minutes, and then the cross-cut peel test with an adhesive cellophane tape was performed on the respective image receptor surfaces in the same manner as in the aforesaid adhesion test for evaluation of the adhesion of the image receptor surfaces. As a result, none of the image receptor surfaces was peeled off, and none of the images thermally transferred to the image receptor surfaces was missing.

(Water Resistance Test)

The mugs respectively formed with the image receptor surfaces were immersed in water at room temperature for 24 hours, and then the adhesion test was performed on the respective image receptor surfaces in the same manner as in the aforesaid adhesion test for evaluation of the adhesion of the image receptor surfaces. As a result, none of the image receptor surfaces was peeled off, and none of the images thermally transferred to the image receptor surfaces was missing.

(Detergent Resistance Test)

The mugs respectively formed with the image receptor surfaces were immersed in an aqueous solution containing a dishwashing detergent (available from Lion Co., Ltd. under the trade name of "CHARMY GREEN") in a concentration of 3 ml/l at room temperature for 24 hours, and then the adhesion test was performed on the respective image receptor surfaces in the same manner as in the aforesaid adhesion test for evaluation of the adhesion of the image receptor surfaces. As a result, none of the image receptor surfaces was peeled off, and none of the images thermally transferred to the image receptor surfaces was missing.

(Bleaching Agent Resistance Test)

The mugs respectively formed with the image receptor surfaces were immersed in an aqueous solution containing a bleaching agent for dishwashing (available from Kao Co., Ltd. under the trade name of "KITCHEN HEIGHTER") in a concentration of 10 ml/l at room temperature for 24 hours, and then the adhesion test was performed on the respective image receptor surfaces in the same manner as in the aforesaid adhesion test for evaluation of the adhesion of the image receptor surfaces. As a result, none of the image receptor surfaces was peeled off, and none of the images thermally transferred to the image receptor surfaces was missing.

(Repetition Test)

The operation of pouring 90° C. water into the respective mugs of Examples 1 to 5 and emptying the mugs was repeated 200 times, whereby the thermochromatic layers of the respective image receptor surfaces experienced 200 cycles of color development and extinction. At every cycle, the color development and extinction and the state of each of the image receptor surfaces were observed. As a result, no change was detected in the colors of the image receptor surfaces at the color development and at the color extinction and in the states of the image receptor surfaces during the 200 cycles of color development and extinction.

(Dishwashing Test)

The mugs respectively formed with the image receptor surfaces were subjected to a dishwashing test in conformity with a test standard specified by Japanese Ceramicware Test Association. As a result, none of the image receptor surfaces was peeled off, and no change was detected in the images thermally transferred to the image receptor surfaces.

(Safety Test)

The mugs respectively formed with the image receptor surfaces were subjected to a heavy metal leaching test in conformity with a test standard specified by Japanese Ceramicware Test Association. As a result, the mugs all satisfied safety requirements.

As described above, the present invention provides an image receptor surface to be formed on a base. A latent image (latent illustration and letters) can be formed in the image receptor surface on the surface of the base (e.g., on a surface of a mug) through thermal image transfer. When the image receptor surface is heated, for example, by hot water to reach a predetermined temperature range, the latent image is made visible in the image receptor surface. Thus, the image receptor surface offers an interesting aesthetic effect. If a ceramic mug or a plastic cup formed with a latent image including a pictorial and textural message is given as a gift to a specific or nonspecific person, for example, the latent image is made visible on the cup when the person pours hot water in the cup, so that the pictorial and textural message can be delivered to the person. The present invention offers an unprecedented image painting method to give a fun and an interest to a user. Particularly, if the image receptor surface is formed of a thermochromatic ink which reversibly changes its color between an image concealable color at ordinary temperature and an image nonconcealable color at a higher temperature, the image once made visible at the higher temperature becomes latent when the image receptor surface is cooled to ordinary temperature. Thus, the image receptor surface offers a further interesting aesthetic effect.

What is claimed is:

1. An image receptor surface which receives an image of a sublimation dye thermally transferred thereto from a foundation sheet for formation of the image therein, the image receptor surface comprising a thermochromatic layer and a resin layer, wherein the thermochromatic layer is provided on the resin layer and contains at least either one of an epoxy resin and an epoxy acrylate resin, and wherein the resin layer contains at least either one of an epoxy resin and an epoxy acrylate resin and at least either one of an acryl resin and a polyester.

2. An image receptor surface which receives an image of a sublimation dye thermally transferred thereto from a foundation sheet for formation of the image therein, the image receptor surface comprising a thermochromatic layer and a resin layer, wherein the thermochromatic layer is provided on the resin layer and contains at least either one of an epoxy resin and an epoxy acrylate resin, wherein the resin layer contains at least either one of an epoxy resin and an epoxy acrylate resin and at least either one of an acryl resin and a polyester, wherein the thermochromatic layer reversibly changes its color between an image concealable color and transparence in a predetermined temperature range, and wherein the thermally transferred image is formed in at least either one of the thermochromatic layer and the resin layer.

3. An image receptor surface which receives an image of a sublimation dye thermally transferred thereto from a foundation sheet for formation of the image therein, the image receptor surface comprising a thermochromatic layer and a resin layer, wherein the thermochromatic layer is provided on the resin layer to partially cover the resin layer and contains at least either one of an epoxy resin and an epoxy acrylate resin, wherein the resin layer contains at least either one of an epoxy resin and an epoxy acrylate resin and at least either one of an acryl resin and a polyester, wherein the thermochromatic layer reversibly changes its color between an image concealable color and transparence in a predetermined temperature range, and wherein the thermally transferred image is formed in at least either one of the thermochromatic layer and the resin layer.

4. A base having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the image receptor surface comprises a resin layer as well as the thermochromatic layer, wherein the thermochromatic layer is provided on the resin layer and contains at least either one of an epoxy resin and an epoxy acrylate resin, and wherein the resin layer contains at least either one of an epoxy resin and an epoxy acrylate resin and at least either one of an acryl resin and a polyester.

5. A base having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the image receptor surface comprises a resin layer as well as the thermochromatic layer, wherein the thermochromatic layer is provided on the resin layer to partially cover the resin layer and contains at least either one of an epoxy resin and an epoxy acrylate resin, and wherein the resin layer contains at least either one of an epoxy resin and an epoxy acrylate resin and at least either one of an acryl resin and a polyester.

6. A base having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the thermally transferred image is formed in the thermochromatic layer, wherein the image receptor surface comprises a resin layer as well as the thermochromatic layer, wherein the thermochromatic layer is provided on the resin layer and contains at least either one of an epoxy resin and an epoxy acrylate resin, where the resin layer contains at least either one of an epoxy resin and an epoxy acrylate resin and a least either one of an acryl resin and a polyester, and wherein the thermally transferred image is formed in at lest either one of the thermochromatic layer and the resin layer.

7. A base having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the thermally transferred image is formed in the thermochromatic layer, wherein the image receptor surface comprises a resin layer as well as the thermochromatic layer, wherein the thermochromatic layer is provided on the resin layer to partially cover the resin layer and contains at least either one of an epoxy resin and an epoxy acrylate resin, wherein the resin layer contains at least either one of an epoxy resin and an epoxy acrylate resin and at least either one of an acryl resin and a polyester, and wherein the thermally transferred image is formed in at least either one of the thermochromatic layer and the resin layer.

8. A mug having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the image receptor surface comprises a resin layer as well as the thermochromatic layer, wherein the thermochromatic layer is provided on the resin layer and contains a least either one of an epoxy resin and epoxy acrylate resin, and wherein the resin layer contains at least either one of an epoxy resin and an epoxy acrylate resin and at least either one of an acryl resin and a polyester.

9. A mug having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the image receptor surface comprises a resin layer as well as the thermochromatic layer, wherein the thermochromatic layer is provided on the resin layer to partially cover the resin layer and contains at least either one of an epoxy resin and an epoxy acrylate resin, and wherein the resin layer contains a least either one of an epoxy resin and an epoxy acrylate resin and at lest either one of an acryl resin and a polyester.

10. A mug having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the thermally transferred image is formed in the thermochromatic layer, wherein the image receptor surface comprises a resin layer as well as the thermochromatic layer, wherein the thermochromatic layer is provided on the resin layer and contains at least either one of the an epoxy resin and an epoxy acrylate resin, wherein the resin layer contains at least either one of an epoxy resin and an epoxy acrylate resin and at least either one of an acryl resin and a polyester, and wherein the thermally transferred image is formed in at least either one of the thermochromatic layer and the resin layer.

11. A mug having an image receptor surface which receives an image of a sublimation dye thermally transferred thereto from a foundation sheet for formation of the image therein, the image receptor surface comprising a thermochromatic layer which reversibly changes its color between an image concealable color and transparence in a predetermined temperature range, wherein the thermally transferred image is formed in the thermochromatic layer, wherein the image receptor surface comprises a resin layer as well as the thermochromatic layer, wherein the thermochromatic layer is provided on the resin layer to partially cover the resin layer and contains at least either one of an epoxy resin and an epoxy acrylate resin, wherein the resin layer contains at least either one of an epoxy resin and an epoxy acrylate resin and at least either one of an acryl resin and a polyester, and wherein the thermally transferred image is formed in at least either one of the thermochromatic layer and the resin layer.

* * * * *